US005771740A

United States Patent [19]

Chang

[11] Patent Number: 5,771,740

[45] Date of Patent: Jun. 30, 1998

[54] FORGE MACHINE

[76] Inventor: Shi-Chi Chang, 58, Ma Yuan West St., Taichung, Taiwan

[21] Appl. No.: 897,231

[22] Filed: Jul. 10, 1997

[51] Int. Cl.[6] ..... B21J 9/18

[52] U.S. Cl. ..... 72/452.5; 72/446; 72/450; 100/257

[58] Field of Search ..... 72/446, 441, 452.2, 72/450; 100/257

[56] References Cited

U.S. PATENT DOCUMENTS

| | | | |
|---|---|---|---|
| 3,726,123 | 4/1973 | Bothe | 72/452.5 |
| 3,908,436 | 9/1975 | Bothe | 72/450 |
| 4,107,973 | 8/1978 | Smejkal | 72/450 |
| 4,464,924 | 8/1984 | Kralowetz | 72/452.5 |
| 5,000,021 | 3/1991 | Nakamura et al. | 72/446 |
| 5,299,443 | 4/1994 | Nakamura | 72/450 |

*Primary Examiner*—David Jones

[57] ABSTRACT

A forge machine has a main body, a motor disposed on a top portion of the main body, a flywheel disposed on an upper portion of the main body and driven by the motor, an eccentric shaft driven by the flywheel, a slide block disposed on the upper portion of the main body, a middle portion of the eccentric shaft inserted in a link seat, a round hole formed on a lower end of the link seat receiving a first drive arm and a second drive arm, an adjusting seat disposed between the first drive arm and the second drive arm, a ball screw rod having a hexagonal flange and a ball formed on a lower end of the ball screw rod, the ball screw rod inserted through a hollow disk, the hollow disk blocked by the hexagonal flange, the ball inserted in an oil press box. An oil pipe is connected to the oil press box and an oil adjusting box. An upper end of the ball screw rod is inserted in the adjusting seat. An axle passes through the slide block, the first drive arm and the second drive arm via the round hole.

4 Claims, 6 Drawing Sheets

FORGE MACHINE

BACKGROUND OF THE INVENTION

The invention relates to a forge machine. More particularly, the invention relates to a forge machine which will protect the forged article against deformation.

Referring to FIGS. 1 and 2, a conventional forge machine 10 has a crank shaft 11, a coupler seat 12 connected to the crank shaft 11, a screw rod 17 disposed beneath the coupler seat 12, an annular clamp 13 clamping a lower portion of the screw rod 17, a ring 14 disposed beneath the annular clamp 13, a hexagonal flange 16 disposed between the ring 14 and the annular clamp 13, a ball-shaped end 18 formed on a lower end of the screw rod 17, a slide seat 20 having an annular seat 19 and two guide rails 21, the annular seat 19 receiving the ball-shaped end 16, a motor 22 disposed on an upper portion of the conventional forge machine 10, a belt 23 surrounding the motor 22 and a flywheel 24, and the flywheel 24 driving the crank shaft 11. The coupler seat 12 moves upward and downward along the guide rails 21.

SUMMARY OF THE INVENTION

An object of the invention is to provide a forge machine which will protect a forged article against deformation.

Another object of the invention is to provide a forge machine which has a ball screw rod with a ball to be controlled by an oil press box.

Accordingly, a forge machine comprises a main body, a motor disposed on a top portion of the main body, a flywheel disposed on an upper portion of the main body and driven by the motor, an eccentric shaft driven by the flywheel, a slide block disposed on the upper portion of the main body, a middle portion of the eccentric shaft inserted in a link seat, a round hole formed on a lower end of the link seat receiving a first drive arm and a second drive arm, an adjusting seat disposed between the first drive arm and the second drive arm, a ball screw rod having a hexagonal flange and a ball formed on a lower end of the ball screw rod, the ball screw rod inserted through a hollow disk, the hollow disk blocked by the hexagonal flange, the ball inserted in an oil press box. An oil pipe is connected to the oil press box and an oil adjusting box. An upper end of the ball screw rod is inserted in the adjusting seat. An axle passes through the slide block, the first drive arm and the second drive arm via the round hole.

DETAILED DESCRIPTION OF THE INVENTION

Figure 1:
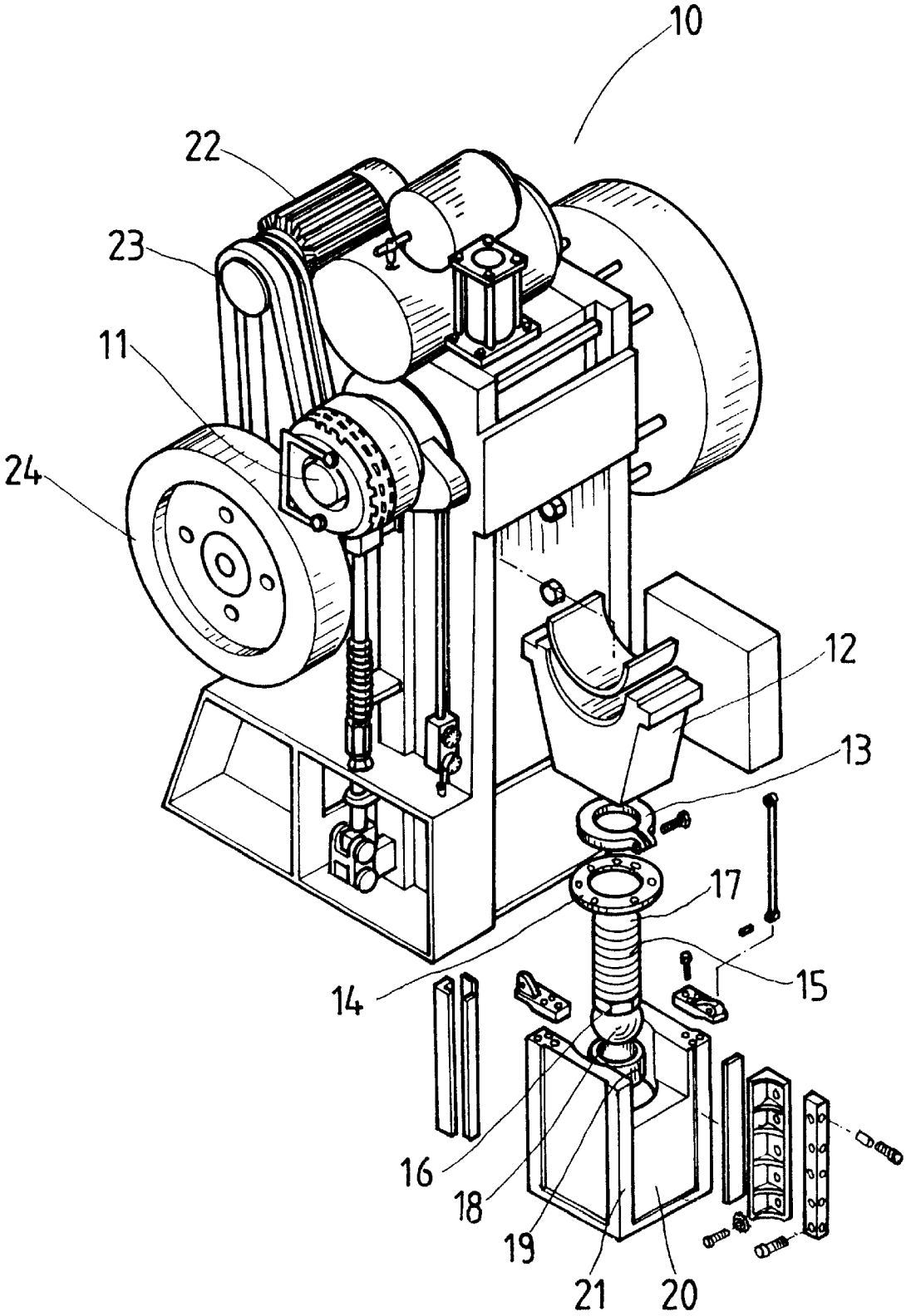
F I G. 1 PRIOR ART
FIG. 1 is a perspective view of a conventional forge machine of the prior art.
Figure 2:
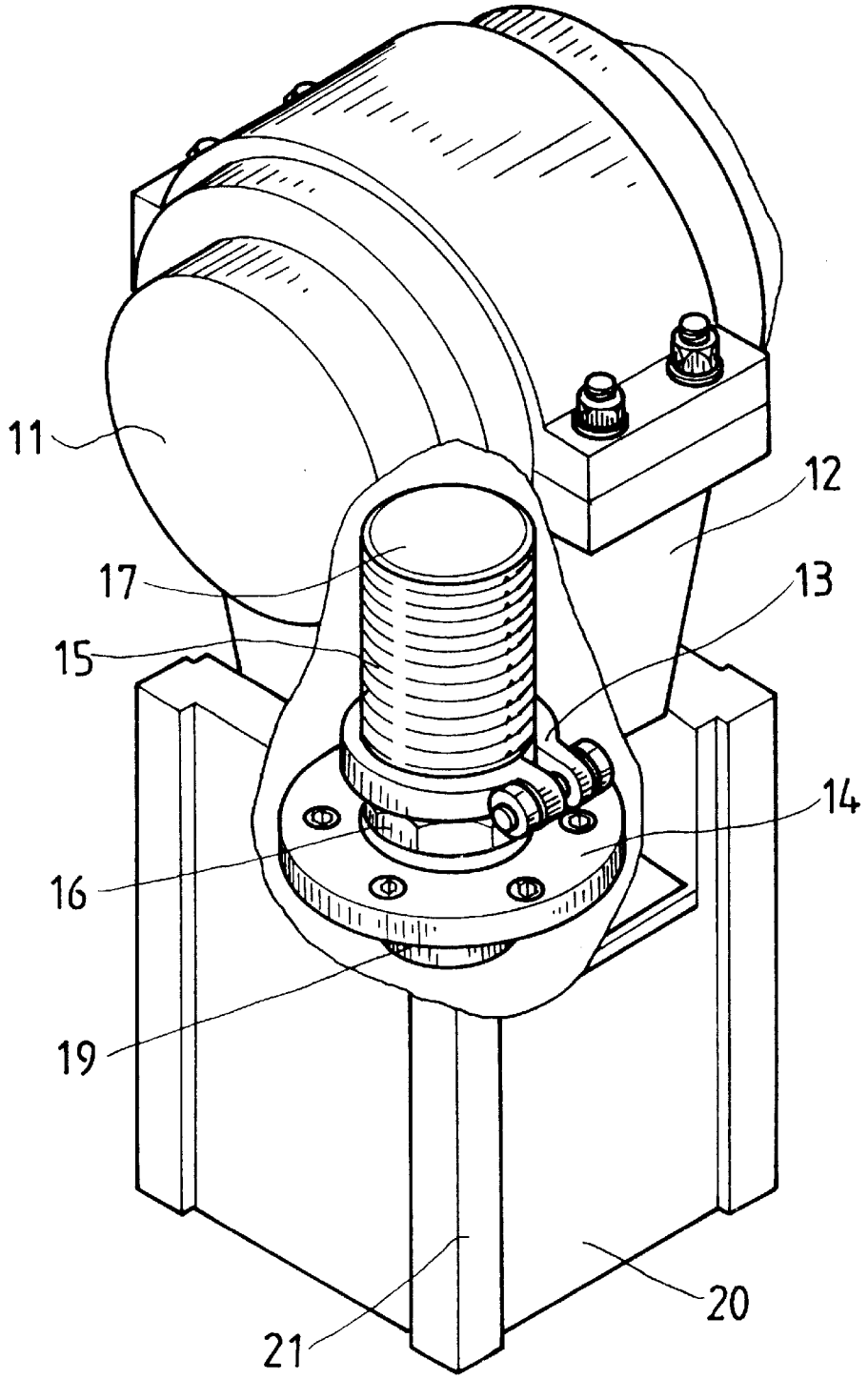
F I G. 2 PRIOR ART
FIG. 2 is a partially enlarged view of FIG. 1.
Figure 3:
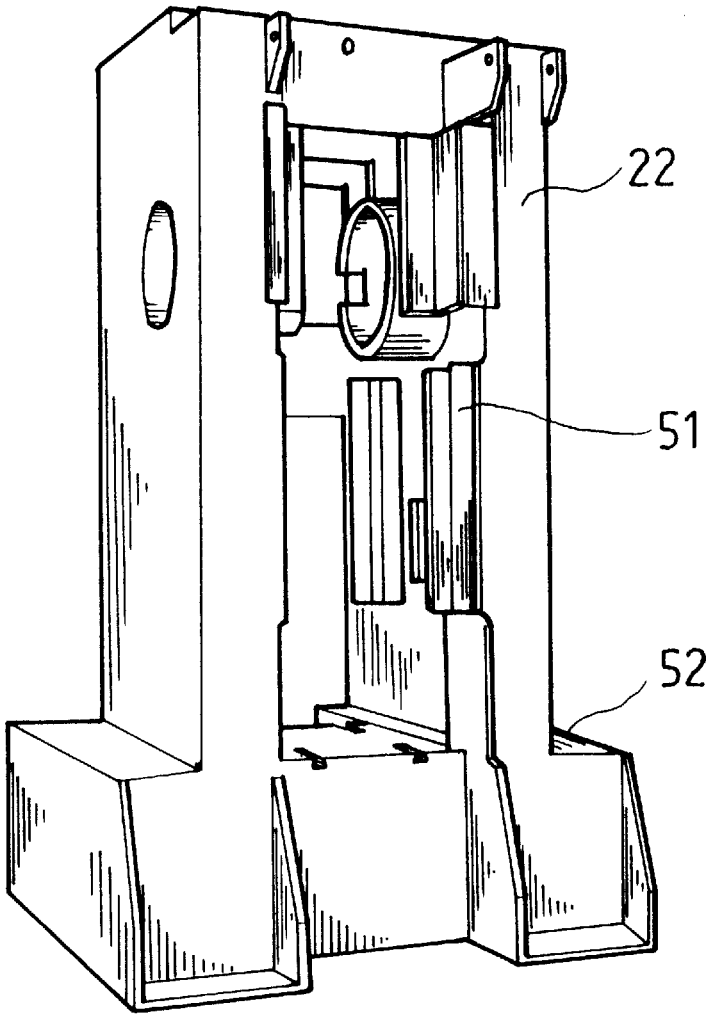
FIG. 3 is a perspective assembly view of a main body of a preferred embodiment in accordance with the invention.
Figure 4:
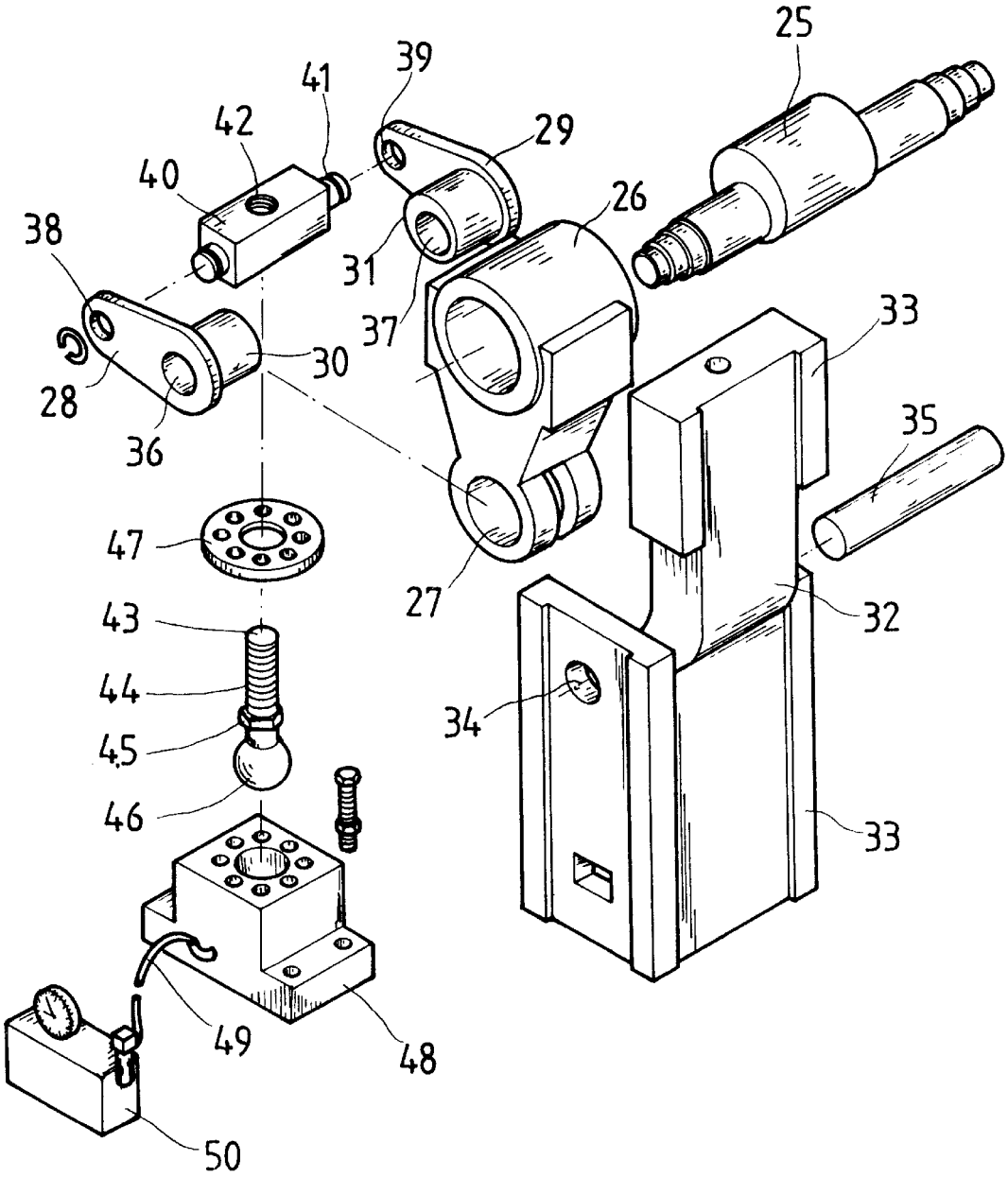
FIG. 4 is a perspective exploded view of a feature structure of a preferred embodiment in accordance with the invention.
Figure 5:
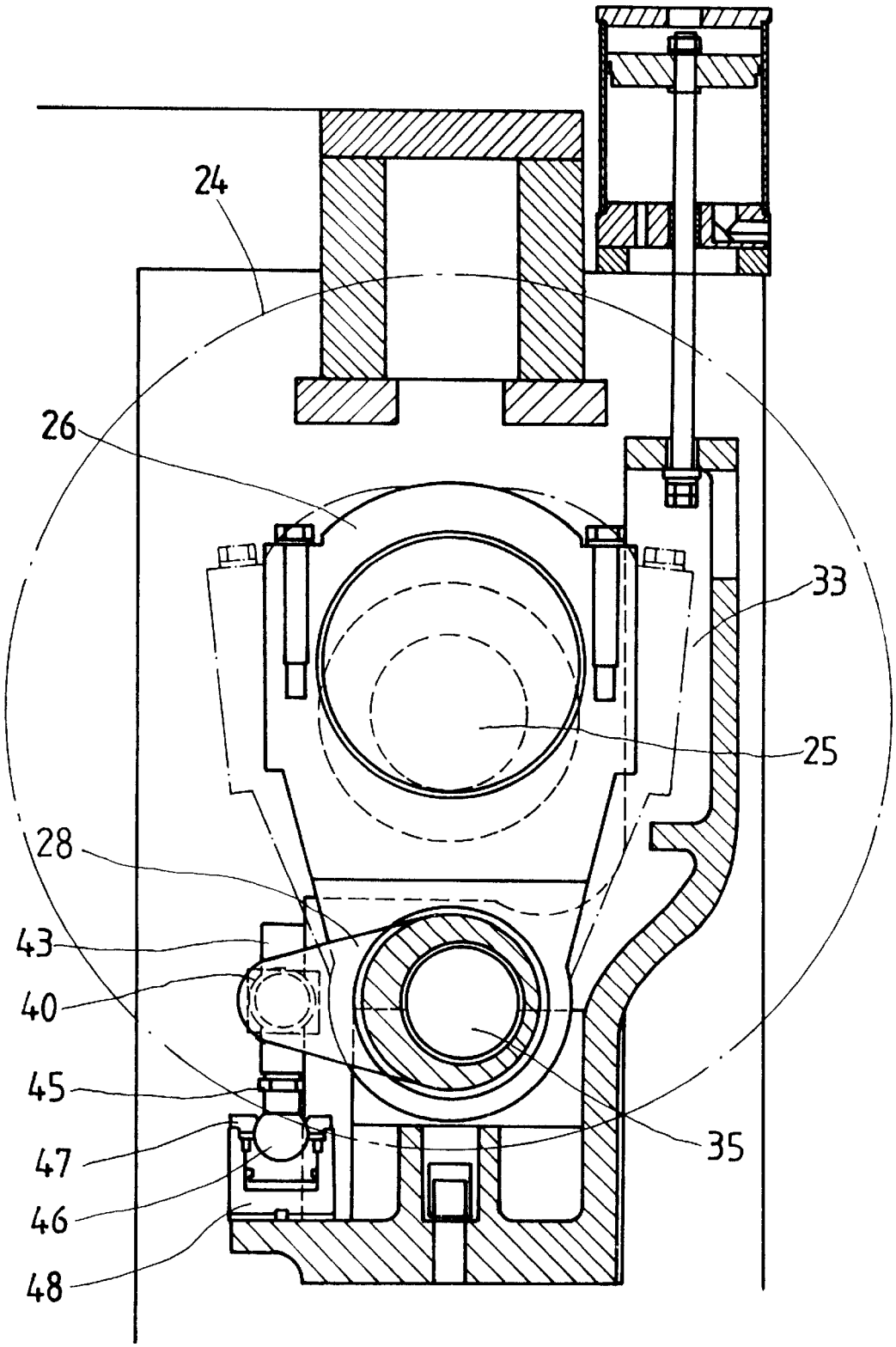
FIG. 5 is a partially sectional view of a forge machine of a preferred embodiment in accordance with the invention.
Figure 6:
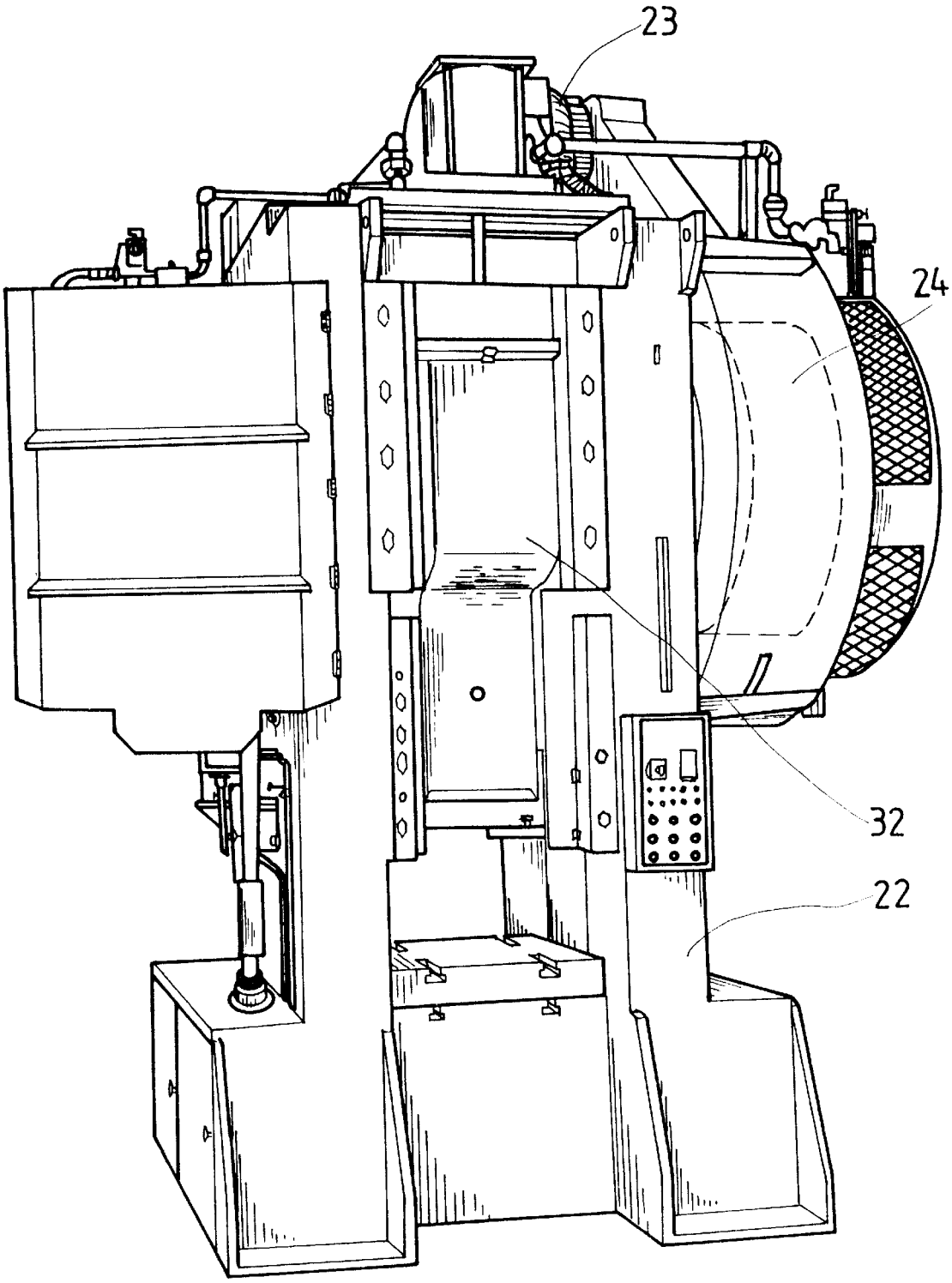
FIG. 6 is a perspective assembly view of a forge machine of a preferred embodiment in accordance with the invention.

Referring to FIGS. 3 to 6, a forge machine comprises a main body 22, a motor 23 disposed on a top portion of the main body 22, a flywheel 24 disposed on an upper portion of the main body 22 and driven by the motor 23, an eccentric shaft 25 driven by the flywheel 24, a slide block 32 disposed on the upper portion of the main body 22, a middle portion of the eccentric shaft 25 inserted in a link seat 26, a round hole 27 formed on a lower end of the link seat 26 receiving a first drive arm 28 and a second drive arm 29, an adjusting seat 40 disposed between the first drive arm 28 and the second drive arm 29, a ball screw rod 43 having a hexagonal flange 45 and a ball 46 formed on a lower end of the ball screw rod 43, the ball screw rod 43 inserted through a hollow disk 47, the hollow disk 47 blocked by the hexagonal flange 45, the ball 46 inserted in an oil press box 48. An oil pipe 49 is connected to the oil press box 48 and an oil adjusting box 50.

The slide block 32 has an upper portion 33, and two slide plates 33 disposed on two opposite laterals of the slide block 32. Each slide plate 33 has a circular hole 34.

The first drive arm 28 has a first positioning hole 38, a first hollow post 30, and a first through hole 36 formed in the first hollow post 30. The second drive arm 29 has a second positioning hole 39, a second hollow post 31, and a second through hole 37 formed in the second hollow post 31.

The adjusting seat 40 has a threaded hole 42, a first protruded end rod 41 inserted in the first positioning hole 38 and a second protruded end rod 41 inserted in the second positioning hole 39. An upper end of the ball screw rod 43 is inserted in the threaded hole 42 of the adjusting seat 40. An axle 35 passes through the slide block 32, the first drive arm 28 and the second drive arm 29 via the round hole 27, the circular holes 34, the first through hole 36 and the second through hole 37.

When the slide block 32 bumps a forged article, an oil in the oil press box 48 is transferred to the oil adjusting box 50. The ball 46 looses the oil pressure of the oil press box 48 so that the ball screw rod 43 will move downward.

The invention is not limited to the above embodiment but various modification thereof may be made. Further, various changes in form and detail may be made without departing from the scope of the invention.

I claim:

1. A forge machine comprises:

a main body, a motor disposed on a top portion of the main body, a flywheel disposed on an upper portion of the main body and driven by the motor, an eccentric shaft driven by the flywheel, a slide block disposed on the upper portion of the main body, a middle portion of the eccentric shaft inserted in a link seat, a round hole formed on a lower end of the link seat receiving a first drive arm and a second drive arm, an adjusting seat disposed between the first drive arm and the second drive arm, a ball screw rod having a hexagonal flange and a ball formed on a lower end of the ball screw rod, the ball screw rod inserted through a hollow disk, the hollow disk blocked by the hexagonal flange, the ball inserted in an oil press box, an oil pipe connected to the oil press box and an oil adjusting box, an upper end of the ball screw rod inserted in the adjusting seat, and an axle passing through the slide block, the first drive arm and the second drive arm via the round hole.

2. A forge machine as claimed in claim 1, wherein the slide block has two slide plates disposed on two opposite laterals of the slide block.

3. A forge machine as claimed in claim 1, wherein the first drive arm has a first positioning hole, a first hollow post, and a first through hole formed in the first hollow post, and the second drive arm has a second positioning hole, a second hollow post, and a second through hole formed in the second hollow post.

4. A forge machine as claimed in claim 3, wherein the adjusting seat has a threaded hole receiving an upper end of the ball screw rod, a first protruded end rod inserted in the first positioning hole and a second protruded end rod inserted in the second positioning hole.

* * * * *